US007073329B2

(12) United States Patent
Brühl et al.

(10) Patent No.: US 7,073,329 B2
(45) Date of Patent: Jul. 11, 2006

(54) MULTI-STAGE OIL PUMPING STATION

(75) Inventors: Reinhold Brühl, Weinstadt (DE); Roland Doll, Weilheim (DE); Frank Weinert, Wimsheim (DE)

(73) Assignee: Daimler Chrysler AG., Stuttgart (DE)

( * ) Notice: Subject to any disclaimer, the term of this patent is extended or adjusted under 35 U.S.C. 154(b) by 28 days.

(21) Appl. No.: 10/866,638

(22) Filed: Jun. 12, 2004

(65) Prior Publication Data

US 2004/0265138 A1 Dec. 30, 2004

(30) Foreign Application Priority Data

Jun. 14, 2003 (DE) ..... 103 26 887

(51) Int. Cl.
*F01M 1/02* (2006.01)

(52) U.S. Cl. ..... 60/486; 417/286

(58) Field of Classification Search ..... 60/486, 60/487; 417/286, 287
See application file for complete search history.

(56) References Cited

U.S. PATENT DOCUMENTS

| | | | | |
|---|---|---|---|---|
| 4,000,616 | A * | 1/1977 | Symmank | 60/486 |
| 4,214,445 | A * | 7/1980 | Winsor et al. | 60/486 |
| 4,424,673 | A * | 1/1984 | Polanski et al. | 60/486 |
| 4,627,239 | A * | 12/1986 | Nishimune et al. | 60/486 |
| 4,635,439 | A * | 1/1987 | Wible | 60/486 |
| 5,477,882 | A * | 12/1995 | Duthie | 60/486 |
| 5,957,229 | A * | 9/1999 | Ishii | 60/484 |
| 6,293,099 | B1 * | 9/2001 | Kamiya | 60/486 |
| 6,477,837 | B1 * | 11/2002 | Kogane et al. | 60/486 |

FOREIGN PATENT DOCUMENTS

| | | |
|---|---|---|
| DE | 39 16 528 | 11/1990 |
| DE | 195 02 235 | 8/1996 |
| DE | 101 40 066 | 2/2000 |

* cited by examiner

*Primary Examiner*—Thomas E. Lazo
(74) *Attorney, Agent, or Firm*—Klaus J. Bach

(57) ABSTRACT

In a multistage oil pumping system for an oil supply system of a motor vehicle comprising at least two oil pumps arrange axially in side-by-side relationship, each of the oil pumps is connected to a separate drive so that the oil pumps can be operated independently of one another.

11 Claims, 1 Drawing Sheet

MULTI-STAGE OIL PUMPING STATION

BACKGROUND OF THE INVENTION

The invention relates to a multi-stage oil pumping system for an oil supply system of a motor vehicle including at least two oil pumps arranged axially adjacent one another.

In modern motor vehicles, the oil supply systems generally need several oil pumps or, respectively, oil pumping stages in which several pumps of the same type or different types of pumps are combined for supplying lubricating oil to various motor components.

DE 195 02 235 A1, for example, discloses an oil supply for a motor vehicle with a two-stage oil pumping system, wherein, in addition to a controllable pump, a constant volume pump is provided and both pumps are driven by a common drive shaft, the pumping direction of the controllable pump being changeable. This known two-stage oil pumping system is unusable for engines of different size because of its pumping characteristics.

The various oil pumps of a multi-stage oil pumping systems are often arranged serially, that is, one after the other or they are arranged in different areas of the engine compartment. With the serial arrangement, however, it is a disadvantage that a relatively long installation space is required. With the arrangement of the different pumps in different areas of the engine compartment on the other hand, the drive arrangement is complicated and the arrangement of the oil lines may also become quite complicated.

With spur gear pumps, it is furthermore possible, to drive in a single plane, two driven gears by a single drive gear. Such a two-stage spur gear pump system is for example disclosed in DE 101 40 066 A1.

Finally, DE 39 16 528 A1 discloses a multistage gear pump system wherein several axially adjacent gear stages are integrated into a housing. In a preferred arrangement, the several gear stages comprise three suction stages and one pressure stage which are all coupled to a shaft and driven by a common drive. This known multi-stage oil pumping system requires only a limited installation space and can be adapted to various internal combustion engine applications.

Based on the state of the art as described above it is the object of the present invention to provide a multi-stage oil pumping system for an oil supply system of a motor vehicle which ensures a high flexibility with regard to the operation of the pump and a high reliability and which additionally requires only a relatively small installation space.

SUMMARY OF THE INVENTION

In a multistage oil pumping system for an oil supply system of a motor vehicle comprising at least two oil pumps arrange axially in side-by-side relationship, each of the oil pumps is connected to a separate drive so that the oil pumps can be operated independently of one another.

With the independent drives for the various oil pumps, any desired pump types as well as suction stages and compression stages can be combined in a common oil pumping system. Furthermore, the operating speeds of the different oil pumps are independently adjustable so that the pumping power of the system is very flexible and can be adjusted to very different operating conditions of a motor vehicle. In contrast to an arrangement including several oil pumps arranged one after the other, also the risk that during operation or during assembly the pumps could jam is very low. With the separate drives, also the mounting and the servicing of the pumps is substantially facilitated since the pumps can be individually attended to and individually replaced. Nevertheless, because the pumps are arranged axially side-by-side a relatively small installation space is required.

In accordance with the invention, all the oil pumps may be arranged in a common drive plane, or alternatively, at least two of the oil pumps are disposed in different drive planes.

Furthermore, in accordance with the invention, the several oil pumps of the oil pumping system may include at least one suction stage and at least one pressure stage.

In addition, at least two of the oil pumps may have a common discharge connection.

The oil pumps of the multi-stage oil pumping system according to the invention may include internal gear pumps, spur gear pumps, wing cell pumps or a combination of these types of pumps.

Further features and combination of features will be become apparent from the following description of various embodiments of the invention on the basis of the accompanying schematic drawings.

DESCRIPTION OF PREFERRED EMBODIMENTS

Figure 1:
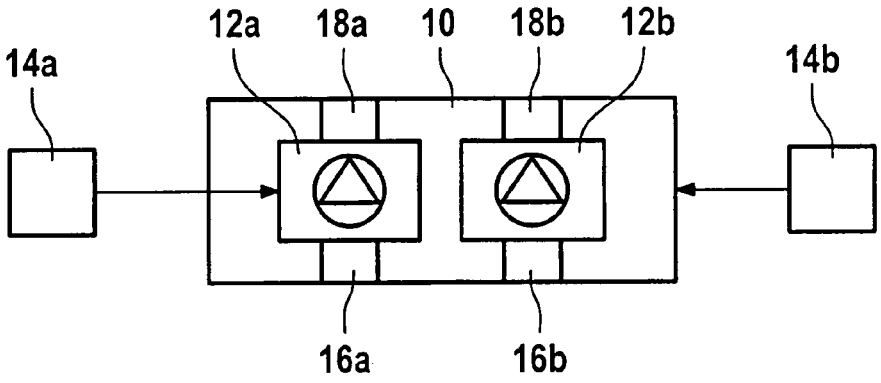
FIG. 1 shows schematically a multi-stage oil pumping system in accordance with a first embodiment of the invention.

FIG. 1 shows in a highly simplified representation a first embodiment of a multi-stage oil pumping system which is used advantageously in an oil supply system of a motor vehicle.

The multistage oil pumping system comprises a housing 10 in which two oil pumps 12*a* and 12*b* are arranged in axial side-by-side relationship. As oil pumps 12*a*, 12*b* ring gear pumps, spur gear pumps, wing cell pumps or similar pumps may be used, wherein the two oil pumps 12*a* and 12*b* of the oil pumping system may be of the same type as well as different types of pumps. Furthermore, the oil pumps 12 and 12*b* may be controllable pumps or constant volume pumps.

Each of the oil pumps 12*a* and 12*b* of the oil pumping system includes its own drive 14*a* and, respectively 14*b*, by which the oil pumps are driven independently of each other. The drives 14*a*, 14*b* may include chain drives, gear drives, belt drives or similar. In addition, the two oil pumps 12*a* and 12*b* may have a common drive plane or their drive planes may be displaced.

In the embodiment of FIG. 1, both oil pumps 12*a* and 12*b* are pressure stages and each has its own suction inlet 16*a* and 16*b* and discharge opening 18*a* and 18*b*.

Because of the separate drives for the two oil pumps 12*a* and 12*b* advantageously, as desired, optimized different pump types may be used, which may be operated independently of each other and at different speeds. In addition, installation and servicing of the individual pumps 12*a* and 12*b* is substantially simplified thereby. The risk of jamming during engine operation or during mounting is substantially reduced in contrast to an arrangement with several oil pumps with a common drive shaft.

Below a second embodiment of a multi-stage oil pumping system according to the invention will be described on the basis of FIG. 2. In this connection, identical components are designated by the same reference numerals as used for the first embodiment shown in FIG. 1.

Figure 2:
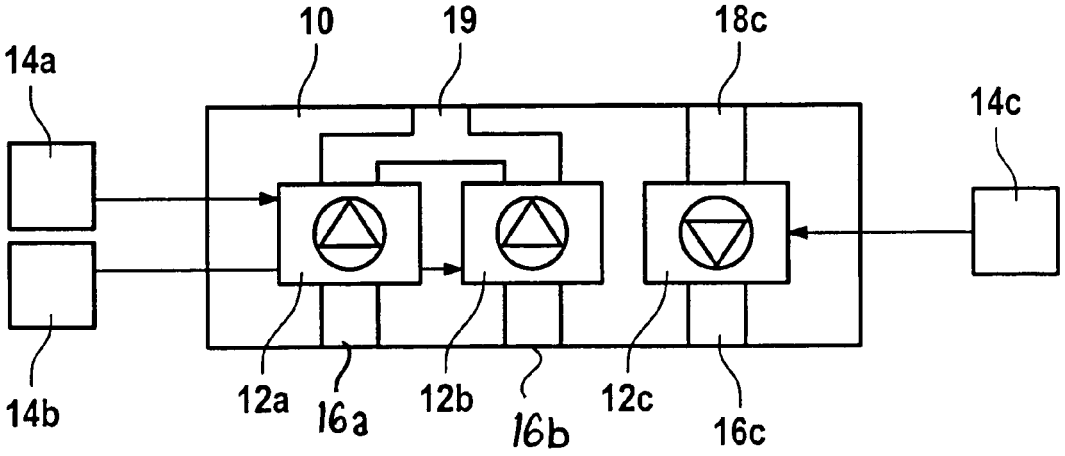
FIG. 2 shows schematically a multi-stage oil pumping system in accordance with a second embodiment of the invention.

The oil pumping system shown in FIG. 2 is a three-stage oil pumping system with three oil pumps 12*a*, 12*b*, 12*c* arranged in axial side-by-side relationship. The two oil pumps 12*a* and 12*b* are pressure stages whereas the third oil pump 12 is a suction stage. All three oil pumps 12*a*, 12*b* and 12*c* are coupled to their own drive 14*a*, 14*b*, and, respectively, 14*c*, so that the three oil pumps can be driven independently of one another. With respect to the types of pumps 12*a*, 12*b*, 12*c* and the drives 14*a*, 14*b*, 14*c*, the statements concerning the embodiment of FIG. 1 apply also here.

While all three oil pumps 12*a*, 12*b* and 12*c* have their own suction inlets 16*a*, 16*b*, 16*c* the two oil pumps 12*a* and 12*b* have a common discharge opening 19 and the third oil pump 12*c* has its own discharge opening 18*c*. With the combination of the two oil pumps 12*a* and 12*b*, oil can be easily be sucked in at two different locations without the need for a second pump stage or a switch over mechanism.

At this point, it is specifically noted that the present invention is not limited to the number two or three oil pumps but that multistage oil pump systems may include more than three oil pumps. Furthermore, the types of oil pumps are not limited to those mentioned above.

The multistage oil pumping system according to the invention requires only a relatively small installation space but has a high flexibility as far as pumping operations are concerned. It is furthermore easy to mount and it is also easy to service the pumps and operation of such a multistage oil pumping system is also highly reliable.

What is claimed is:

1. A multistage oil pumping system for an oil supply system of a motor vehicle, comprising a pump housing (10) at least two oil pumps (12*a*, 12*b*, 12*c*) arranged axially side-by-side in said pump housing (10), at least two of said oil pumps (12*a*, 12*b*, 12*c*) having a common discharge opening (19) and each of said oil pumps having its own separate drive (14*a*, 14*b*, 14*c*) so that the oil pumps can be operated independently of one another.

2. A multistage oil pumping system according to claim 1, wherein all oil pumps (12*a*, 12*b*, 12*c*) have a common drive plane.

3. A multistage oil pumping system according to claim 1, wherein at least two of said oil pumps (12*a*, 12*b*, 12*c*) have displaced drive planes.

4. A multistage oil pumping system according to claim 1, wherein said oil pumps (12*a*, 12*b*, 12*c*) have at least one suction stage and one pressure stage.

5. A multistage oil pumping system according to claim 1, wherein said oil pumps consist of at least one of controllable pumps and constant volume pumps.

6. A multistage oil pumping system for an oil supply system of a motor vehicle, comprising a pump housing (10), at least two oil pumps (12*a*, 12*b*, 12*c*) arranged axially side-by-side in said pump housing (10), said oil pumps (12*a*, 12*b*, 12*c*) consisting of at least one of a ring gear pump, a spur gear pump and a wing cell pump and each of said oil pump having its own separate drive (14*a*, 14*b*, 14*c*) so that the oil pump can be operated independently of one another.

7. A multistage oil pump system according to claim 6, wherein all oil pumps (12*a*, 12*b*, 12*c*) have a common drive plane.

8. A multistage oil pump system according to claim 6, wherein at least two of said oil pumps (12*a*, 12*b*, 12*c*) have displaced drive planes.

9. A multistage oil pump system according to claim 6, wherein said oil pumps (12*a*, 12*b*, 12*c*) have at least one suction stage and one pressure stage.

10. A multistage oil pump system according to claim 6, wherein said oil pumps consist of at least one of controllable pumps and constant volume pumps.

11. A multistage oil pump system according to claim 6, wherein at least two of said oil pumps (12*a*, 12*b*, 12*c*) have a common discharge opening (19).

* * * * *